United States Patent [19]

Müller

[11] Patent Number: 4,564,183

[45] Date of Patent: Jan. 14, 1986

[54] FOLDING APPARATUS FOR A WEB-FED ROTARY PRINTING MACHINE

[75] Inventor: Hans Müller, Leimen, Fed. Rep. of Germany

[73] Assignee: Heidelberger Druckmaschinen AG, Heidelberg, Fed. Rep. of Germany

[21] Appl. No.: 699,032

[22] Filed: Feb. 7, 1985

[30] Foreign Application Priority Data

Feb. 7, 1984 [DE] Fed. Rep. of Germany ..... 3404170

[51] Int. Cl.[4] ..... B41F 13/56

[52] U.S. Cl. ..... 270/21.1; 493/368

[58] Field of Search ..... 270/20.1, 21.1; 493/361, 363, 367, 368

[56] References Cited

U.S. PATENT DOCUMENTS

| | | | |
|---|---|---|---|
| 4,073,485 | 2/1978 | Gregoire et al. | 493/368 X |
| 4,496,338 | 1/1985 | Michalik | 493/367 |
| 4,524,962 | 6/1985 | Davenport et al. | 270/21.1 |

FOREIGN PATENT DOCUMENTS

| | | | |
|---|---|---|---|
| 3030775 | 2/1982 | Fed. Rep. of Germany | 270/21.1 |
| 3030706 | 2/1982 | Fed. Rep. of Germany | 270/21.1 |
| 3030705 | 2/1982 | Fed. Rep. of Germany | 270/21.1 |
| 3151283 | 4/1983 | Fed. Rep. of Germany | 270/21.1 |

*Primary Examiner*—E. H. Eickholt

*Attorney, Agent, or Firm*—Herbert L. Lerner; Laurence A. Greenberg

[57] ABSTRACT

A folding apparatus for a web-fed rotary printing machine having a train of successive cylinders including a slot-type collecting cylinder, a blade cylinder with two cutting blades disposed on the periphery thereof for cutting full format lengths off a web and with cam-controlled folding blades offset 90° from the cutting blades, a folding-jaw cylinder with two controlled folding jaws disposed at the periphery thereof and a cam-controlled folding blade offset by 45° downstream from the folding jaws, and a second cross-folding cylinder having two gripper rows cooperating with the folding jaws of the folding-jaw cylinder and having two controlled folding jaws offset downstream from the gripper rows and cooperating with the folding blades of the folding jaw cylinder includes three needle rows for collecting being disposed with equal mutual spacing around the periphery of the slot-type collecting cylinder, the periphery of the collecting cylinder being able to accept three half format lengths of the web; two additional removable cutting blades located on the blade cylinder at an offset of 90° from the cutting blades already fixed thereon and being disposed together with the folding blades of the blade cylinder on a common support pivotable into a respective working position, the folding-jaw cylinder carrying controllable folding-blade spindles selectively with respective mutually opposing folding blades on a leading side thereof and removable needle rows on a trailing side thereof, the folding-jaw cylinder and a control cam carried thereby being pivotable into working position in accordance with the folded product to be produced; and the second cross-folding cylinder carrying two controlled folding-jaw spindles for selectively carrying a gripper row and a folding-jaw half, depending upon the folded product to be produced whereby, selectively, by turning the body of the second cross-folding cylinder and a control cam mounted thereon, a respective folding jaw is bringable into operative connection with a respective folding blade of the folding-jaw cylinder, and the gripper row of the second cross-folding cylinder is bringable into operative connection with a respective needle row of the folding-jaw cylinder.

5 Claims, 4 Drawing Figures

FOLDING APPARATUS FOR A WEB-FED ROTARY PRINTING MACHINE

The invention relates to a folding apparatus for a web-fed rotary printing machine and, more particularly, to such a folding apparatus having a train of successive cylinders including a slot-type collecting cylinder, a blade cylinder with two cutting blades disposed on the periphery thereof for cutting full format lengths off a web and with cam-controlled folding blades offset 90° from the cutting blades, a folding-jaw cylinder with two controlled folding jaws disposed at the periphery thereof and a cam-controlled folding blade offset by 45° downstream from the folding jaws, and a second cross-folding cylinder having two gripper rows cooperating with the folding jaws of the folding-jaw cylinder and having two controlled folding jaws offset downstream from the gripper rows and cooperating with the folding blades of the folding jaw cylinder.

Such folding machines as disclosed in German Published Non-Prosecuted Application (DE-OS) No. 32 24 173, are used for producing so-called folded products, such as magazines or periodicals, especially, and are adjustable or convertible in accordance with the required types of folds. The instant it becomes necessary, however, to produce solely longitudinally folded products having half the format length and a small number of sides, besides the conventional folded products, problems arise which can be solved only with very great technical expense. It is therefore also frequently necessary to collect these solely longitudinally folded products with four sides in order to obtain a finished product having twice four sides. Such products are usually envelopes or brochures such as leaflets or folders which, for example, may be enclosed with newspapers.

For producing such collected products, in the conventional construction of a folding apparatus, an additional collecting cylinder, an additional fly and an additional belt delivery are required which are housed in a separate frame. Besides the additional technical and financial expense, the conversion or readjustment of the folding apparatus from one to the other type of production calls for a considerable expenditure of time.

Another folding apparatus for longitudinally and crossfolded products is disclosed in German Published Non-Prosecuted application (DE-OS) No. 2 517 000 wherein an additional cutting/collecting cylinder, which feeds the collected and longitudinally folded product to a separate sheet delivery, is disposed beneath the folding blade cylinder. Apart from the additional technical expense, the equipment provided for further conveying the finished folded products must be connectible for both sheet deliveries provided in opposite directions. An additional cost factor also arises thereby which is of disadvantage when making an overall evaluation of such a folding apparatus.

An object of the invention is therefore to provide a conventional apparatus for web-fed rotary printing machines, which cuts a web to format length and makes a first and a second cross-fold as well as a delta fold, which is modified in construction, without great cost or expensive for converting or readjusting operations, so that it is also possible to deliver twice four sides collected with half format length and longitudinally folded.

With the foregoing and other objects in view, there is provided, in accordance with the invention, a folding apparatus for a web-fed rotary printing machine having a train of successive cylinders including a slot-type collecting cylinder, a blade cylinder with two cutting blades disposed on the periphery thereof for cutting full format lengths off a web and with cam-controlled folding blades offset 90° from the cutting blades, a folding-jaw cylinder with two controlled folding jaws disposed at the periphery thereof and a cam-controlled folding blade offset by 45° downstream from the folding jaws, and a second cross-folding cylinder having two gripper rows cooperating with the folding jaws of the folding-jaw cylinder and having two controlled folding jaws offset downstream from the gripper rows and cooperating with the folding blades of the folding jaw cylinder, comprising three needle rows for collecting being disposed with equal mutual spacing around the periphery of the slot-type collecting cylinder, the periphery of the collecting cylinder being able to accept three half format lengths of the web; two additional removable cutting blades located on the blade cylinder at an offset of 90° from the cutting blades already fixed thereon and being disposed together with the folding blades of the blade cylinder on a common support pivotable into a respective working position, the folding-jaw cylinder carrying controllable folding-blade spindles selectively with respective mutually opposing folding blades on a leading side thereof and removable needle rows on a trailing side thereof, the folding-jaw cylinder and a control cam carried thereby being pivotable into working position in accordance with the folded product to be produced; and the second cross-folding cylinder carrying two controlled folding-jaw spindles for selectively carrying a gripper row and a folding-jaw half, depending upon the folded product to be produced whereby, selectively, by turning the body of the second cross-folding cylinder and a control cam mounted thereon, a respective folding jaw is bringable into operative connection with a respective folding blade of the folding-jaw cylinder, and the gripper row of the second cross-folding cylinder is bringable into operative connection with a respective needle row of the folding-jaw cylinder.

In accordance with another feature of the invention, there are provided supports pivotable with respect to the body of the folding-jaw cylinder for carrying both of the folding jaws thereof.

In accordance with a further feature of the invention, the gripper rows of the second cross-folding cylinder cooperating with the folding jaws of the folding-jaw cylinder are disposed on supports pivotable with respect to the cylinder body of the second cross-folding cylinder.

In accordance with an added feature of the invention, each removable needle row on the folding-jaw cylinder is disposed on a bar fastenable to the folding-jaw spindle.

In accordance with a concomittant feature of the invention, the gripper row on the second cross-folding cylinder cooperating with the needle row of the folding-jaw cylinder is fastened to the controlled folding-jaw spindle on holders of the folding-jaw half which has been removed.

A basic advantage of the foregoing construction is that a quite normal or conventional folding apparatus may be used for the aforementioned types of production without requiring any additional units which might render servicing or operation thereof more difficult and might cause considerable additional costs. Also, no increased expense for assembly is required for change-overs in production, so that shut-down times of the printing machine may be minimized.

Other features which are considered as characteristic for the invention are set forth in the appended claims.

Although the invention is illustrated and described herein as embodied in a folding apparatus for a web-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
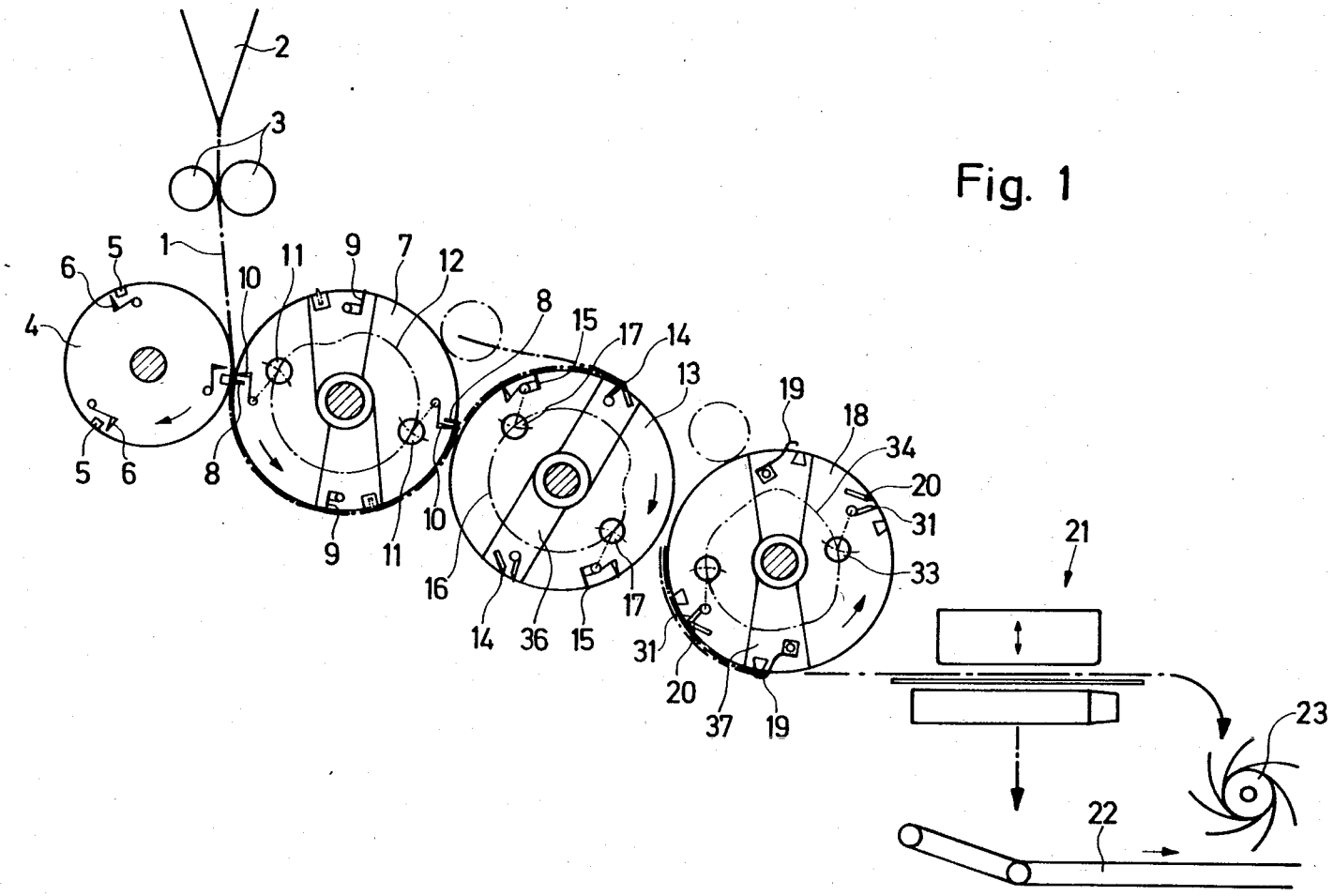
FIG. 1 is a diagrammatic side elevational view of a folding apparatus for conventional production of folded products having a given format length.

Referring now to the drawing and first, particularly, to FIG. 1 thereof, there is shown diagrammatically a folding apparatus wherein a paper web 1 is folded longitudinally by a former or kite 2 and fed via draw members 3 to a slot-type collecting cylinder 4. The latter has a periphery equal in length to three half-format lengths and is accordingly furnished with three rubber bars offset 120° from one another, around the periphery. As seen in rotary direction of the collecting cylinder 4, controlled needle rows 6 are mounted directly downstream of the respective rubber bars 5, the needles, as shown in FIG. 1, being ineffective or inactive.

The slot or groove-type collecting cylinder 4 is followed by a blade or cutting cylinder 7 which carries two cutting knives or blades 8 offset 180° from one another on the periphery of the cylinder 7 and cooperating with the rubber bars 5 on the slot-type collecting cylinder 4. It is thereby possible to cut off, in-register, two full format lengths from the paper web 1.

Two folding blades or choppers 9 controlled by a non-illustrated cam are provided on the blade cylinder 7 offset 90°, respectively, from the cutting blades 8. Needle rows 10 are, furthermore, mounted on the blade or cutting cylinder 7 downstream from the cutting blades 8 and are controlled via cam rollers 11 and a control cam 12.

A folding-jaw cylinder 13 cooperating with the blade cylinder 7 carries two folding jaws 14 offset 180° from one another and having one half thereof controlled. Furthermore, two folding blades 15 are cooperatively associated with and trail the folding jaws 14 by 45°, the folding blades 15 being controllable via a cam 16 and control rollers 17.

A second crossfolding cylinder 18 is located downstream from the folding jaw cylinder 13, in travel direction of the paper web 1, and carries two gripper rows 19 offset 180° on the periphery thereof and cooperating with the folding jaws 14. In addition, controlled folding jaws 20 are provided trailing the gripper rows 19 by 45° on the periphery of the cylinder 18 and able to cooperate with the folding blades 15 on the folding jaw cylinder 13.

In the illustrated embodiment, a second longitudinal folder 21 follows the cross-folding cylinder 18 and deposits the folded products via non-illustrated flies on a conveyor belt, as represented by the broken-line arrow in FIG. 1. If the second longitudinal fold 21 is not required, the cross-folded products can be deposited likewise on the conveyor belt 22 via a fly 23. The conveyor belt 22 can feed the finished products, for example, via a non-illustrated conveyor system, for further processing within the printing plant.

In this folding apparatus, the format lengths which have already been longitudinally folded by the former or kite 2 and cut off by the cutting blades 8 are taken over by the needle rows 10 and transported to a location above a median line between the blade cylinder 7 and the folding-jaw cylinder 13. The instant the respectively following folding blade 9 arrives in the median line between the two cylinders 7 and 13, it presses the cut-off format length at the middle thereof into the appertaining folding jaw 14 which is then closed and conveys the folded product further on. The needle rows 10 thereby move back and clear the leading edge of the sheet. The folded product then located on folding-jaw cylinder 13 can be fed via the gripper rows 19 directly to the longitudinal folder 21 or the fly 23. If a second cross fold is required, the folding jaw 14 conveys the folded product to a location above the median line between the folding-jaw cylinder 13 and the second cross-folding cylinder 18. When the appertaining folding blade 15 reaches the median line between the two cylinders 7 and 13, the folded product is pressed at the middle thereof into the opened folding jaw 20 appertaining thereto. After the latter has closed, the product which has been cross-folded for the second time is then delivered in the aforedescribed manner.

Figure 2:
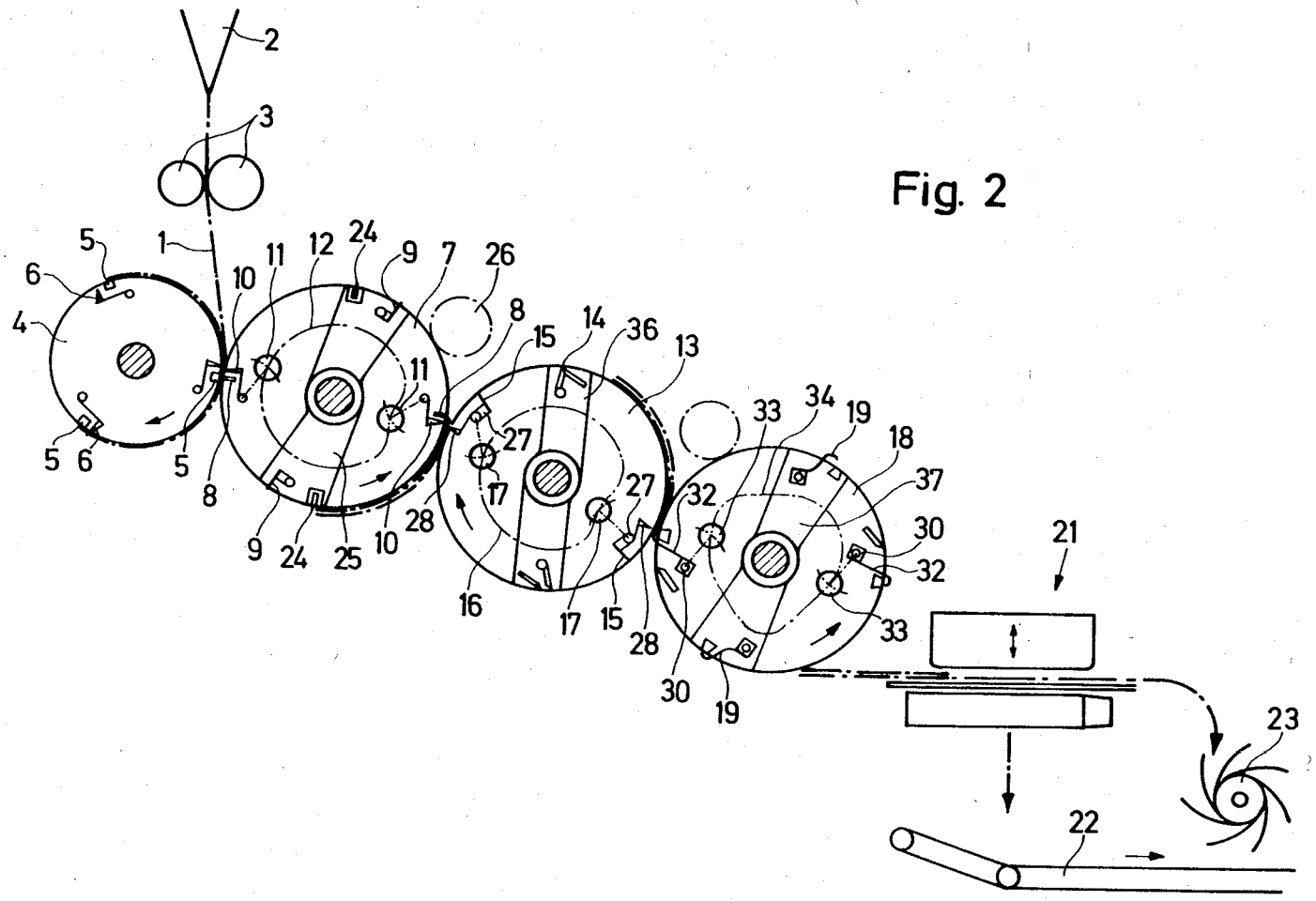
FIG. 2 is a view similar to that of FIG. 1 of a folding apparatus according to the invention of the instant application producing a longitudinally folded product with two sets of four sides.

With the construction according to FIG. 2, two products having four sides, respectively, and having previously been folded longitudinally by the former 2 are to be collected successively so that a product with a total of eight sides results. For this purpose, two cutting blades 24 are removably provided in the blade cylinder 7, offset by 90° from the cutting blades 8. The cutting blades 24 also cooperate with the rubber bars 5 of the slot-type collecting cylinder 4. It is thereby possible to cut the paper web 1 to half of the format length. The first web section with half of the format length is then taken over by a needle row 6 and guided 360° around the slot-type collecting cylinder 4. Then, in the median line between the slot-type collecting cylinder 4 and the blade or cutting cylinder 7, the second web section is laid onto the first web section. The appertaining needle row 6 is so controlled that the first web section is released, and the needle row 10 simultaneously takes over both web sections in the blade or cutting cylinder 7 and conveys them, further onwardly. The second section length is then likewise cut half the format length by the next following cutting blade 8 or 24.

Both the additional removable cutting blade 24 as well as the two folding blades 9 on the blade or cutting cylinder 7 are disposed on both sides on a respective support 25 swingable into a 90° working position. The swinging movement occurs via a clampable adjusting device 26.

In the illustrated embodiment of FIG. 2, the folding blade 15 is removed from each folding-blade spindle 27 on the folding-jaw cylinder 13, and a removable needle row 28 disposed on the trailing side. Control of the folding-blade spindle 27 is effected thereby via the same control cam 16, the latter being turnable merely by a small amount. The same applies also to the folding-jaw cylinder 13 per se, this being accomplishable, for example, by loosening the clamping screws on the drive wheel. In the median line between the blade cylinder 7 and the folding-jaw cylinder 13, the needle row 28 then takes over the collected product from the needle row 10, both of these needle rows being so represented that they are in equal alignment, but have needles which are offset side-by-side from one another. The folding-jaw cylinder 13 then serves solely as a means of conveyance for the collected product to a succeeding or following second cross-folding cylinder 18.

The second cross-folding cylinder 18 carries two controlled folding-jaw spindles 30 which, in the construction according to FIG. 1, bear the controlled folding-jaw halves 31. In the embodiment of the invention according to FIG. 2, the folding-jaw halves 31 are replaced by a gripper row 32 controlled via cam rollers 33 and a control cam 34. The control cam 34 serves for controlling the folding-jaw half in the embodiment according to FIG. 1. Also, in the case of the second cross-folding cylinder, it is necessary to swing the cylinder body and the control cam 34 into working position so that they can cooperate with the needle row 28 of the folding-jaw cylinder 13. Thus, the collected products fed from the needle row 28 can be taken over by the respectively appertaining gripper row 32 and fed via a non-illustrated belt-line to the fly 23 which then deposits them on the conveyor belt 22. The production of a second longitudinal fold is not appropriate for these collected products.

Figure 3:
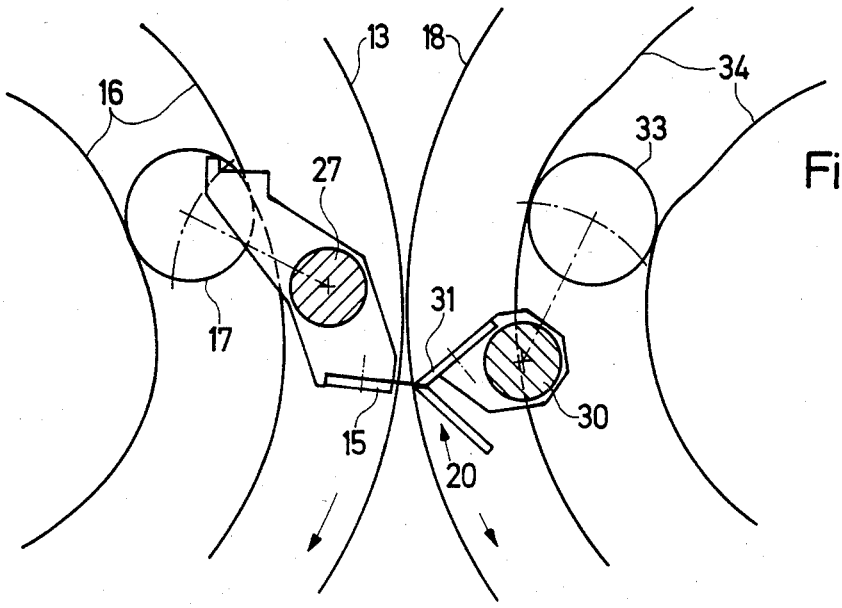
FIG. 3 is an enlarged fragmentary view of FIG. 1 with the folding apparatus in a different operating phase thereof, and showing a folding jaw/folding blade arrangement forming a part thereof.

FIG. 3 shows an embodiment with a folding blade 15 and a folding jaw 20 which corresponds to that of FIG. 1. In this case, the controlled folding-jaw half 31 takes over the non-illustrated folded product from the folding blade 15 of the folding-jaw cylinder 13.

Figure 4:
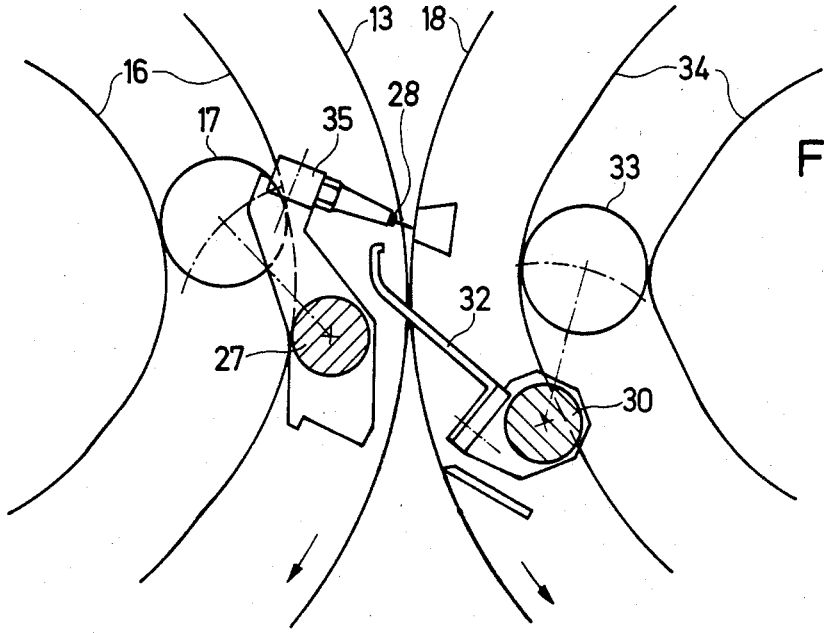
FIG. 4 is an enlarged fragmentary view of FIG. 2 showing a changed-over gripper/needle arrangement forming part of the folding apparatus according to the invention.

In FIG. 4, the folding-jaw cylinder 13 and the second cross-folding cylinder 18 are likewise shown in a sectional view corresponding to that of FIG. 2. In this case, a needle row 28 on a strip or bar 35 is fastened to the folding-blade spindle 27 on the trailing side thereof, instead of the folding blade 15. The strip or bar 35, in turn, is threadedly securable in a relatively simple manner to the folding-blade spindle 27. A gripper row 32 cooperates with the needle row 28 in the illustrated embodiment of FIG. 4, and is fastened to the controlled folding-jaw spindle 30 on the second cross-folding cylinder 18. In this regard, holders of the removed folding-jaw half 31 are used. The control of both the folding-blade spindle 27 as well as the folding-jaw spindle 30 is effected via the aforedescribed control cams 16 and 34.

To produce a δ-fold, for example, both folding jaws 14 are disposed on the folding jaw cylinder 13 on supports 36 which are pivotable with respect to the body of the cylinder 13. For the same purpose, the gripper row 19 of the second cross-folding cylinder 18 cooperating with the folding jaw 14 of the folding-jaw cylinder 13 can also be disposed on a support 37 which is pivotable with respect to the body of the cylinder 13. This construction may be used alternatively in the embodiment according to FIG. 1.

The foregoing is a description corresponding in substance to German Application No. P 34 04 170.2, dated Feb. 7, 1984, the International priority of which is being claimed for the instant application, and which is hereby made part of this application.

I claim:

1. Folding apparatus for a web-fed rotary printing machine having a train of successive cylinders including a slot-type collecting cylinder, a blade cylinder with two cutting blades disposed on the periphery thereof for cutting full format lengths off a web and with cam-controlled folding blades offset 90° from the cutting blades, a folding-jaw cylinder with two controlled folding jaws disposed at the periphery thereof and a cam-controlled folding blade offset by 45° downstream from the folding jaws, and a second cross-folding cylinder having two gripper rows cooperating with the folding jaws of the folding-jaw cylinder and having two controlled folding jaws offset downstream from the gripper rows and cooperating with the folding blades of the folding jaw cylinder, comprising three needle rows for collecting being disposed with equal mutual spacing around the periphery of the slot-type collecting cylinder, the periphery of the collecting cylinder being able to accept three half format lengths of the web; two additional removable cutting blades located on the blade cylinder at an offset of 90° from the cutting blades already fixed thereon and being disposed together with the folding blades of the blade cylinder on a common support pivotable into a respective working position, the folding-jaw cylinder carrying controllable folding-blade spindles selectively with respective mutually opposing folding blades on a leading side thereof and removable needle rows on a trailing side thereof, the folding-jaw cylinder and a control cam carried thereby being pivotable into working position in accordance with the folded product to be produced; and the second cross-folding cylinder carrying two controlled folding-jaw spindles for selectively carrying a gripper row and a folding-jaw half, depending upon the folded product to be produced whereby, selectively, by turning the body of the second cross-folding cylinder and a control cam mounted thereon, a respective folding jaw is bringable into operative connection with a respective folding blade of the folding-jaw cylinder, and said gripper row of the second cross-folding cylinder is bringable into operative connection with a respective needle row of the folding-jaw cylinder.

2. Folding apparatus according to claim 1 including supports pivotable with respect to the body of the folding-jaw cylinder for carrying both of the folding jaws thereof.

3. Folding apparatus according to claim 1 wherein the gripper rows of the second cross-folding cylinder cooperating with the folding jaws of the folding-jaw cylinder are disposed on supports pivotable with respect to the cylinder body of the second cross-folding cylinder.

4. Folding apparatus according to claim 1 wherein each removable needle row on the folding-jaw cylinder is disposed on a bar fastenable to said folding-jaw spindle.

5. Folding apparatus according to claim 1, wherein said gripper row on the second cross-folding cylinder cooperating with said needle row of the folding-jaw cylinder is fastened to said controlled folding-jaw spindle on holders of the folding-jaw half which has been removed.

* * * * *